US011585178B2

(12) United States Patent
Kunz

(10) Patent No.: US 11,585,178 B2
(45) Date of Patent: Feb. 21, 2023

(54) CASING EXPANDER FOR WELL ABANDONMENT

(71) Applicant: Winterhawk Well Abandonment Ltd., Calgary (CA)

(72) Inventor: Dale Kunz, Calgary (CA)

(73) Assignee: Winterhawk Well Abandonment Ltd., Calgary (CA)

( * ) Notice: Subject to any disclaimer, the term of this patent is extended or adjusted under 35 U.S.C. 154(b) by 15 days.

(21) Appl. No.: 15/734,171

(22) PCT Filed: Jun. 1, 2018

(86) PCT No.: PCT/CA2018/050661

§ 371 (c)(1),
(2) Date: Dec. 1, 2020

(87) PCT Pub. No.: WO2019/227195

PCT Pub. Date: Dec. 5, 2019

(65) Prior Publication Data

US 2021/0230957 A1 Jul. 29, 2021

(51) Int. Cl.

| | |
|---|---|
| ***E21B 29/08*** | (2006.01) |
| ***E21B 29/10*** | (2006.01) |
| ***E21B 43/10*** | (2006.01) |

(52) U.S. Cl.

CPC ..... *E21B 29/08* (2013.01); *E21B 29/10* (2013.01); *E21B 43/103* (2013.01); *E21B 43/105* (2013.01)

(58) Field of Classification Search

CPC ..... E21B 29/08; E21B 29/10; E21B 29/105; E21B 29/00; E21B 43/10; E21B 43/103; E21B 43/105

See application file for complete search history.

(56) References Cited

U.S. PATENT DOCUMENTS

| | | | |
|---|---|---|---|
| 2,119,252 | A | 5/1938 | Thaheld |
| 3,068,942 | A | 12/1962 | Brown |

(Continued)

FOREIGN PATENT DOCUMENTS

| | | |
|---|---|---|
| CA | 2487286 | 12/2003 |
| CA | 2759158 | 8/2007 |

(Continued)

OTHER PUBLICATIONS

International Searching Authority, International Search and Written Opinion, dated Feb. 19, 2019 in PCT/CA2018/050661.

(Continued)

*Primary Examiner* — Nicole Coy
*Assistant Examiner* — Nicholas D Wlodarski
(74) *Attorney, Agent, or Firm* — Critical Path IP Law, LLC

(57) ABSTRACT

A tool is provided for expanding the casing at one or more locations for arresting surface casing vent flow in an abandoned well. A setting tool is run into the bore having an expansion element supported thereon. The setting tool imparts a large axial force to radially expand the expansion element for plastically deforming the casing. A single use, pleated ring crushable expansion element can be actuated and left downhole. The pleated ring tool can be pre-charged with a highly viscous fluid, semi solid for transport, but plastic under load. A multi-use expansion element can be actuated, released, moved and actuated again at successive locations.

19 Claims, 11 Drawing Sheets

(56) References Cited

U.S. PATENT DOCUMENTS

| | | | | |
|---|---|---|---|---|
| 3,464,709 | A * | 9/1969 | Eckenrod | F16J 15/20 277/342 |
| 3,561,527 | A | 2/1971 | Nelson | |
| 4,069,573 | A | 1/1978 | Rogers, Jr. et al. | |
| 4,116,451 | A | 9/1978 | Nixon et al. | |
| 4,127,168 | A | 11/1978 | Hanson et al. | |
| 4,444,400 | A * | 4/1984 | Norman | E21B 33/03 285/39 |
| 4,483,399 | A | 11/1984 | Colgate | |
| 4,688,640 | A | 8/1987 | Pritchard | |
| 4,716,965 | A | 1/1988 | Bol et al. | |
| 5,124,254 | A | 6/1992 | Hewlins et al. | |
| 5,127,473 | A | 7/1992 | Harris | |
| 6,581,682 | B1 | 6/2003 | Parent et al. | |
| 6,622,797 | B2 | 9/2003 | Sivley, IV | |
| 6,725,917 | B2 | 4/2004 | Metcalfe | |
| 7,000,704 | B2 * | 2/2006 | Smith | E21B 23/01 166/207 |
| 7,168,497 | B2 * | 1/2007 | Metcalfe | E21B 7/20 166/207 |
| 7,367,391 | B1 | 5/2008 | Stuart et al. | |
| 7,506,687 | B2 * | 3/2009 | Ring | E21B 43/103 166/207 |
| 7,703,542 | B2 | 4/2010 | O'Connor et al. | |
| 8,453,729 | B2 | 6/2013 | Harris et al. | |
| 9,303,477 | B2 | 4/2016 | Harris et al. | |
| 9,752,408 | B2 | 9/2017 | Robben | |
| 10,794,158 | B2 | 10/2020 | Cornelissen | |
| 2001/0045284 | A1 | 11/2001 | Simpson et al. | |
| 2002/0121372 | A1 | 9/2002 | Cook | |
| 2005/0056433 | A1 | 3/2005 | Ring | |
| 2005/0217865 | A1 | 10/2005 | Ring | |
| 2007/0095532 | A1 * | 5/2007 | Head | E21B 43/105 166/207 |
| 2008/0105431 | A1 | 5/2008 | Baaijens | |
| 2008/0142213 | A1 | 6/2008 | Costa et al. | |
| 2008/0223568 | A1 | 9/2008 | Roggebond et al. | |
| 2009/0321084 | A1 | 12/2009 | Simmons | |
| 2010/0019426 | A1 | 1/2010 | Kunz | |
| 2010/0122820 | A1 | 5/2010 | Holland | |
| 2010/0319427 | A1 | 12/2010 | Lohbek | |
| 2012/0097391 | A1 | 4/2012 | Whiddon | |
| 2015/0285026 | A1 | 10/2015 | Frazier | |
| 2017/0145782 | A1 * | 5/2017 | Ferg | E21B 47/00 |
| 2018/0163490 | A1 | 6/2018 | Styler | |
| 2019/0169951 | A1 * | 6/2019 | Frazier | E21B 33/1204 |
| 2019/0352987 | A1 * | 11/2019 | Hrupp | E21B 23/04 |

FOREIGN PATENT DOCUMENTS

| | | |
|---|---|---|
| CA | 2842406 | 8/2015 |
| CA | 2913933 | 12/2015 |
| CN | 2433389 | 6/2001 |
| CN | 103184866 | 7/2013 |
| EP | 2599955 | 6/2013 |
| WO | WO 2017/091911 | 6/2017 |
| WO | WO 2017/197517 | 11/2017 |
| WO | WO 2018083069 | 5/2018 |

OTHER PUBLICATIONS

Byrom T.G. Casing and Liners for Drilling and Completion. Design and Application. Gulf Drilling Guides. Second Edition. Sections 6.9.1-6.9.4 and p. 201.

Hill et al. Large Elastic Compression of Finite Rectangular Blocks of Rubber. Q. Ji Mech. Appl. Math 42(2), pp. 267-287. Oxford University Press, 1989.

Jackson, R.E. Gas Release Mechanisms from Energy Wellbores. ARMA 14-7753. 48th US Rock Mechanics / Geomechanics Symposium. Minneapolis, MN, USA, Jun. 1-4, 2014.

Khandka, R.K. Leakage Behind Casing. IPG 4920 Drilling Specialization Thesis Work. NTNU, Jun. 11, 2007.

Kupresan, D. et al. Experimental Assessment of Casing Expan . . . IADC/SPE SPE-168056-MS. 2014 IADC/SPE Drilling Conference and Exhibition. Fort Worth, Texas, USA, Mar. 4-6, 2014.

Lakes, R. Compression of a block. http://silver.neep.wisc.edu/~lakes/EMA611block.html. May 27, 2018.

Pinarbasi, S. et al. Compression of solid and annular circular discs bonded to rigid surfaces. International Journal of Solids and Structures 45 (2008) 4543-4561.

Sridharan, K. Deformation Analysis of Rubber Blocks Under Large Compressive Strain. JCHPS Special Issue 9: Apr. 2015, pp. 130-136.

Technology Subgroup of the Operations & Environment Task Group. Paper #2-25. Plugging and Abandonment of Oil and Gas Wells. NPC North American Resource Sep. 15, 2011, pp. 1-21.

Yeoh, O.H. The Compression Modulus of Tall Rubber Cylinders. J. Rubb. Res, Inst. Malaysia, 33(3), 109-114, 1985.

Yuanhua, L. et al. An experimental study on reshaping C110 deformed casing with spinning casing swage. Natural Gas Industry B (2015) 257-262.

George E. King Engineering. Plug and Abandonment—Producing Well. Slides. Mar. 14, 2009. GEKEngineering.com.

Global CCS Institute. 2. Well Plugging and Abandonment Techniques. 2016.

ITF. Through Tubing Logging—Plugging and Abandonment. Call for Proposals. Aug. 2015.

Alberta Energy Regulator—Directive 020. Well Abandonment. Mar. 15, 2016.

International Search Report and Written Opinion issued on International PCT Application No. PCT/CA2018/050661 dated Feb. 19, 2019.

Extended European Search Report on European Patent Application No. 18920425.8 dated Dec. 3, 2021.

Written Opinion issued on Singapore Patent Application No. 11202011981S dated Feb. 16, 2022.

Machine English Translation of Chinese Patent Application No. 2433389, having a publication date of Jun. 6, 2001.

Machine English Translation of Chinese Patent Application No. 103184866, having a publication date of Jul. 3, 2013.

USPTO Office Action in U.S. Appl. No. 17/334,975 dated Aug. 18, 2022.

USPTO Office Action in U.S. Appl. No. 17/334,975 dated Nov. 29, 2022.

* cited by examiner 104
20
122
144
44

122
146

F
120
142
144
146
154
152
54

F
106
120
160
142
13
F
122
146
10
12

106
122
160
152
140
154
44
13
144
142
52
10
12
54

CASING EXPANDER FOR WELL ABANDONMENT

CROSS REFERENCE TO RELATED APPLICATION

This application is a national stage filing under 35 U.S.C. § 371 of international application PCT/CA2018/050661, filed Jun. 1, 2018 and titled "Casing Expander for Well Abandonment," the disclosure of which is hereby incorporated herein by reference in its entirety.

FIELD

The current disclosure is directed to a tool and system for implementing abandonment procedures for cemented wellbores.

BACKGROUND

Wells access subterranean hydrocarbon formations for the recovery of oil and gas. Once the well is exhausted or other failures, procedures are in place to abandon the well while protecting other resources including the prevention of the contamination of potable water sources and preclusion of surface leakage. Abandonment procedures have been developed in the oil and gas industry including steps to prevent underground inter-zonal communication and fluid migration up the well and into shallow drinking water aquifers or to surface.

The Alberta Energy Regulator, Alberta Canada, currently requires that a "bridge plug" be installed in the well, ostensibly above any source of fluids, as the first step in well abandonment. The bridge plug comprises a mechanical tool having a body carrying slips and an expandable, elastomeric seal ring. The tool can be operated by a tubing string extending down from ground surface. The slips are expanded to engage the casing and secure the tool in place. The seal ring is expanded to seal against the casing's inner surface. The body and seal ring thereby combine to close and seal the cased bore.

During the conventional abandonment procedure the bridge plug is positioned and set at a pre-determined depth in the casing bore. A hydraulic pressure test is then carried out to determine if the bridge plug and well casing are competent to hold pressure. The pressure test is currently performed by filling the casing bore with water and applying pressure at 1000 psi for 10 minutes. After it has been determined that both the bridge plug and the casing above the bridge plug are competent, a column of cement (typically 40 feet in length) is deposited in the bore immediately above the bridge plug. Finally, the top end of the steel casing is cut off at a point below ground level and a vented cap is welded on the upper end of the casing.

However, problems can commonly arise over time with this system for plugging and abandoning wells. For example, the elastomeric element of the bridge plug may develop surface cracks or otherwise deteriorate and allow fluid to leak past it. Minute or micro-annular cracks may also develop about the cement column where the cement abuts the inside surface of the casing. Further, the cement sheath in the annulus, around the outside of the casing, can shrink and develop fracture. One or more of these defects can result in natural gas or other fluid leaking either up through the cased bore or along the outside surface of the casing. Such leakage indicates that the abandonment process has failed. This failure is commonly identified when vegetation surrounding the well at ground surface begins to die. Further remediation is required once the location of the leak along the well is determined.

Prior detection of the location of leaks, using logging systems, has been expensive and circumstantial, measuring parameters of the cased wellbore that are indicative of the potential for a leak, but not determinative. Logging systems in use include acoustic, video, caliper, neutron, gamma and the like. Often the tools are used on combination. Logs are sometimes run under pressure to heighten resolution in some circumstances. Accordingly the current logging systems result in diagnostic costs in the order of 25 to 75 thousand dollars.

More currently, as set forth in Applicant's PCT Patent Application PCT/CA2017/050596, entitled DIAGNOSTIC TOOL FOR WELL ABANDONMENT TOOL, published as WO 2017/197517 on Nov. 23, 2017 a tool is provided for diagnosing a downhole source of a surface casing vent flow (SCVF), the tool being rapidly relocatable along the well for temporary restriction annular leaks. The tool has a stack of pleated rings slidably mounted on a tubular mandrel. One end of the stack is set to engage with the casing and the stack is compressed axially to expand the pleated rings expand the casing for diminishing casing/cement micro-annular cracks. The rings are dimensioned for insertion in the casing bore and yet when compressed are operative to expand radially sufficiently to press against the casing wall and provide a circumferential frictional interlock or engagement with the casing. When surface casing vent flow is reduced, the downhole source is thereby identified for remediation and, if not reduced, the tool is released, traversed uphole and actuated again.

Presently there are tens of thousands of wells in Alberta, Canada that have been abandoned. However, many have been identified as leaking fluid to ground surface. An operator, having identified a leak is still in need of a means to economically plug a leak or leaks for proper abandonment plug procedures under the regulations.

If plug procedures are not successful, remedial work is required and retesting completed for packer isolation, all of which adds significantly to well abandonment costs.

SUMMARY

Basically two techniques have been used for expandable casing, typically for coupling casing at a liner hanger: swaging and a roller tool, both of which are tools that are dragged axially along the casing, a swage tool being tapered and having a largest diameter that this greater than that of the casing inner diameter. The roller also has a diameter greater than that of the casing inner diameter, but using multiple rollers, typically three or four rollers, providing variable expansion into the casing about the circumference. Both require actuation over a greater axial extent than the target location. Further, the success of both is dependent on the uniformity of the casing, the force applied, lubricants, variability in expansion.

Applicant hereby provides casing expansion element for actuation and remediation of well surface casing at a target location for a well suffering from annular cement integrity deficiencies. The tool imparts a radially outward and expansive plastic deformation to the casing at a point location, typically above a leak source. Applicant notes that others have determined that, surprisingly, micro-annular channeling and fractures healed after compression. Once one has determined a target location of the well casing is located that is at or above a source of a surface casing leak, the casing can be expanded at that location, permanently and with a diametral magnitude to remediate leaking thereby. In one embodiment, a specialized form of one-time use pleated ring tool is provided to convert axial displacement into radial displacement. In another embodiment, an elastomeric element is provided which is capable of multiple uses. As the casing expanding causes plastic deformation, the expanded casing retaining its expanded dimensions, the expansion element need not be left in the well.

A conveyance string, including a wireline or tubing conveyed running tool, incorporating a linear or axial actuator, is also disclosed for providing the axial displacement. The force needed to effect radial expansion to expand the casing is significant. At depth in wells, the most convenient approach is to implement an actuator that applies axial forces, and then convert the axial force to radial forces. The running tool is modular, having additive axial force modules that can be stacked for increasing axial force delivery.

Accordingly, in one embodiment, a single use casing expansion element is conveyed downhole and actuated at the target location. In another embodiment a multiple use, resettable expansions tool is provided.

In one broad aspect, a downhole tool is conveyable downhole along the axis of a well casing and comprising a setting tool having an axial actuator and an expansion element having a first diameter for conveyance along the casing. The expansion element is compressible axially by the axial actuator for expanding radially to a second diameter for plastic deformation of the casing.

In one embodiment the expansion element is a single use stack of pleated rings which can be expanded and abandoned downhole. In another embodiment, the expansion element is an elastomeric element which can be expanded, contracted and moved along the casing.

In another broad aspect, a method for in-situ expansion of well casing comprises conveying an expansion element downhole on a conveyance string to a specified location along the casing. The element is expanded radially outwards to plastically expand the casing at the specified location; and thereafter the expansion element is released. In an embodiment, after releasing the expansion element, the expansions element is conveyed along the casing to a successive specified location for repeating the actuating and element-releasing steps.

In other embodiments, element is single use and the releasing of the expansion element is to release the element from the conveyance string for abandonment in the casing and in others, the element is multi-use and the releasing of the expansion element comprises contracting the element radially inwards from the expanded casing. In the single use case, the expanding of the element radially may be irreversible. In the multi-use case the expanding of the element radially is reversible.

In another aspect, the method is applied to remediation of a well having a cement sheath thereabout, the actuating of the element to plastically expand the casing at the specified location further comprises compressing the cement sheath to compact the cement. The method can be applied to successive joints of casing.

In another aspect, the method is applied remediation of an abandoned well completed with casing and having a cemented sheath thereabout at least a portion thereof, the well exhibiting surface casing vent flow originating at or below a specific location.

DETAILED DESCRIPTION

Figure 1:
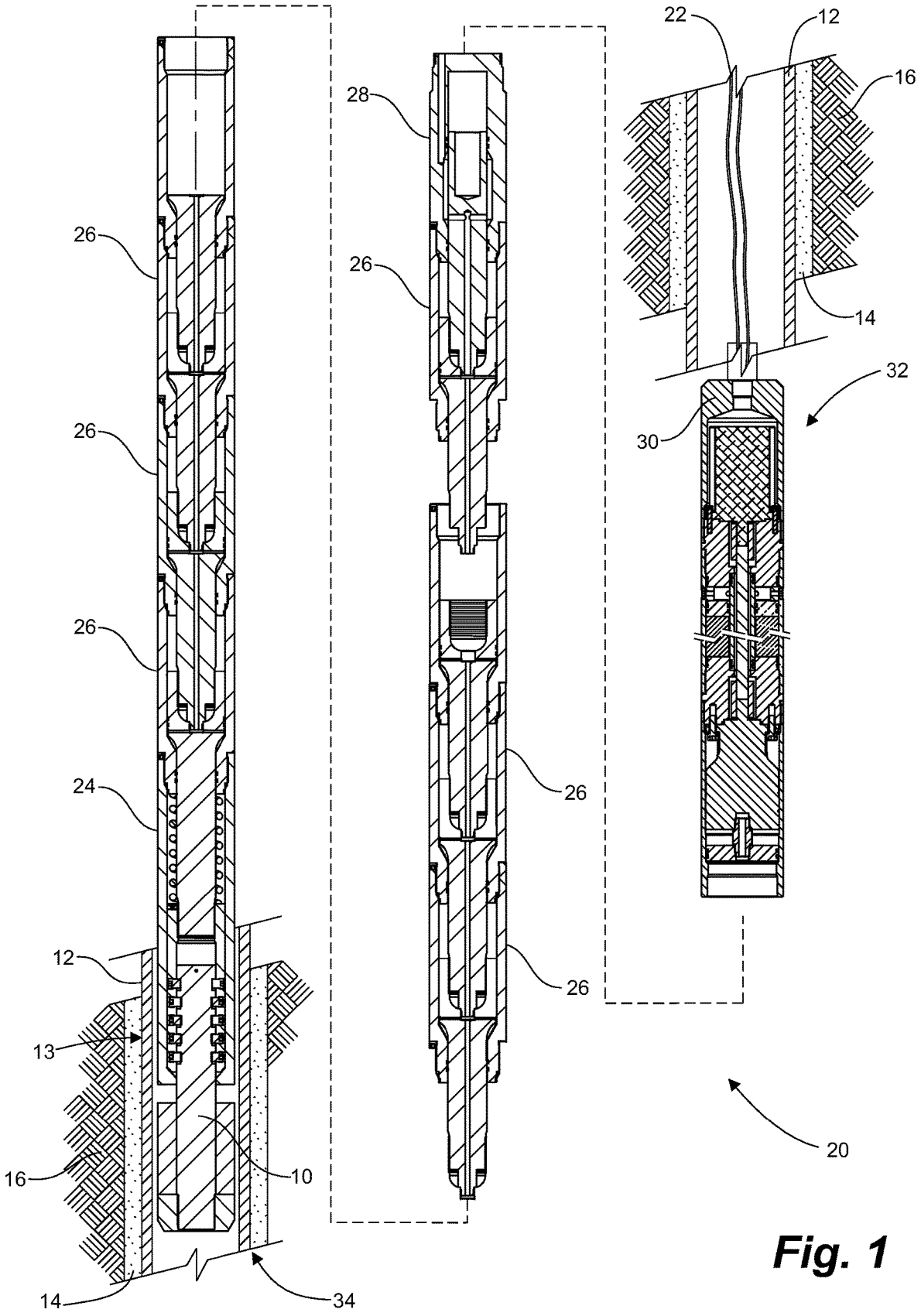
FIG. 1 is an expanded cross-sectional view of a wireline setting tool and expansion element according to one embodiment.

With reference to FIG. 1, a casing expansion element 10 is provided for localized and permanent expansion of well casing 12 at a target location 13. In one embodiment, the casing expansions is performed for remediation of a well suffering from integrity deficiencies of a cement sheath 14 in an annulus about the casing 12 and a subterranean formation 16. In other embodiments, localized expansion, and the control over extent of expansions and location thereof, is also useful in the securing of liner hangers and scab liner casing patches.

In the context of well remediate for well abandonment, a running and setting tool 20 is provided for running the expansion element 10 downhole to the target location 13 and actuation thereof for plastically expanding the casing 12, such as for remediation of surface casing vent flow issues. The casing 12 is expanded into the cement sheath 14 surrounding the casing 12. The cement sheath 14 is compressed at the point of expansion. Permanent deformation of the casing 12 maintains contact of the expanded casing 12 with the compressed, volume-reduced cement sheath 14.

Applicant notes that others have determined that, surprisingly, integrity issues of the cement sheath 14, including micro-annular channeling and fractures, do heal after having experienced significant compression. Once one has determined a location 13 of the well casing 12 that is at or above a source of a surface casing leak, the casing is expanded permanently, and with a diametral magnitude to remediate leaking thereby. As set forth in IADC/SPE SPE-168056-MS, entitled "Experimental Assessment of Casing Expansion as a Solution to Microannular Gas Migration, it was determined that expanding casing through a swaging technique, applied generally along a casing, compresses the cement, and though the cements consistency changes it does regain its solid structure and compressive strength.

In the embodiment disclosed herein, the expansion element 10 is a material or metamaterial which accepts an axially compressive actuation force resulting in radial expansion. More commonly known as Poisson's Ratio as applied to homogeneous materials, it is also a convenient term for the behavior of composite or manufactured materials. Sometimes such manufactured materials are referred to as meta-materials, usually on a small material properties scale, but also applied here in the context of an assembly of materials that are intractable a in homogenous form, e.g. a block of steel, but are more pliable in less dense manufactured forms.

The expansion element is conveyed down the well casing 12 by the setting tool 20, on tubing or wireline 22 (as shown) to the specified location 13 for remediation. The setting tool 20 imparts significant axial actuating forces to the expansion element for a generating a corresponding radial expansion. The force of the radial expansion causes plastic deformation of the casing 12 at the specified location 13.

The setting tool 20 comprises an actuating sub 24, one or more piston modules 26,26 . . . , a top adapter sub 28, and a power unit 30.

The setting tool 20 has an uphole end 32 for connection with the wireline 22 typically incorporated with the power unit. The expansion element is operatively connected at one end or the other of the setting tool. In an embodiment, the expansion element 10 is supported at a downhole end 34, at the actuating sub 24, and thereby separates a conveyance end from the expansion element end.

When the setting tool is equipped with an expansion element 10 for single use, such as the stack of pleated rings described below, is configured with the expansion element 10 at the downhole end 34, permitting release and abandonment of the expansion element downhole and subsequent recovery of the setting tool 20 by pulling-out-of-hole thereabove. An expansion element 10 capable of multi-use could be located at either end, but is practically located again at the downhole end 34 as illustrated for separation again of conveyance and expansion functions, or for emergency release of the more risky expansion element.

Pleated Expander

With reference to FIGS. 2A, 2B, 2C and 3, in one embodiment, the expandable element 10 is a metamaterial assembly of metal components, some of which are folded, which have a high compressibility as the metal is forced to unfold and rigid metal components to control the axial and radial behavior of the folded metal. Actuation of the pleated ring-form of expandable element 10 results in irreversible deformation thereof and is intended for single use.

This embodiment of the expandable element 10 is a stack 40 of pleated rings 42 slidably mounted on a mandrel 44. Each ring 42 is separated and spaced axially apart from an adjacent ring 42 by a flat, annular washer 46. The behavior of pleated rings 42 for sealing a wellbore within the well casing 12 is also described in Applicant's international application PCT/CA2016/051429 filed Monday, Dec. 5, 2106 and claiming priority of CA 2,913,933 filed Dec. 4, 2015.

Figure 2A:
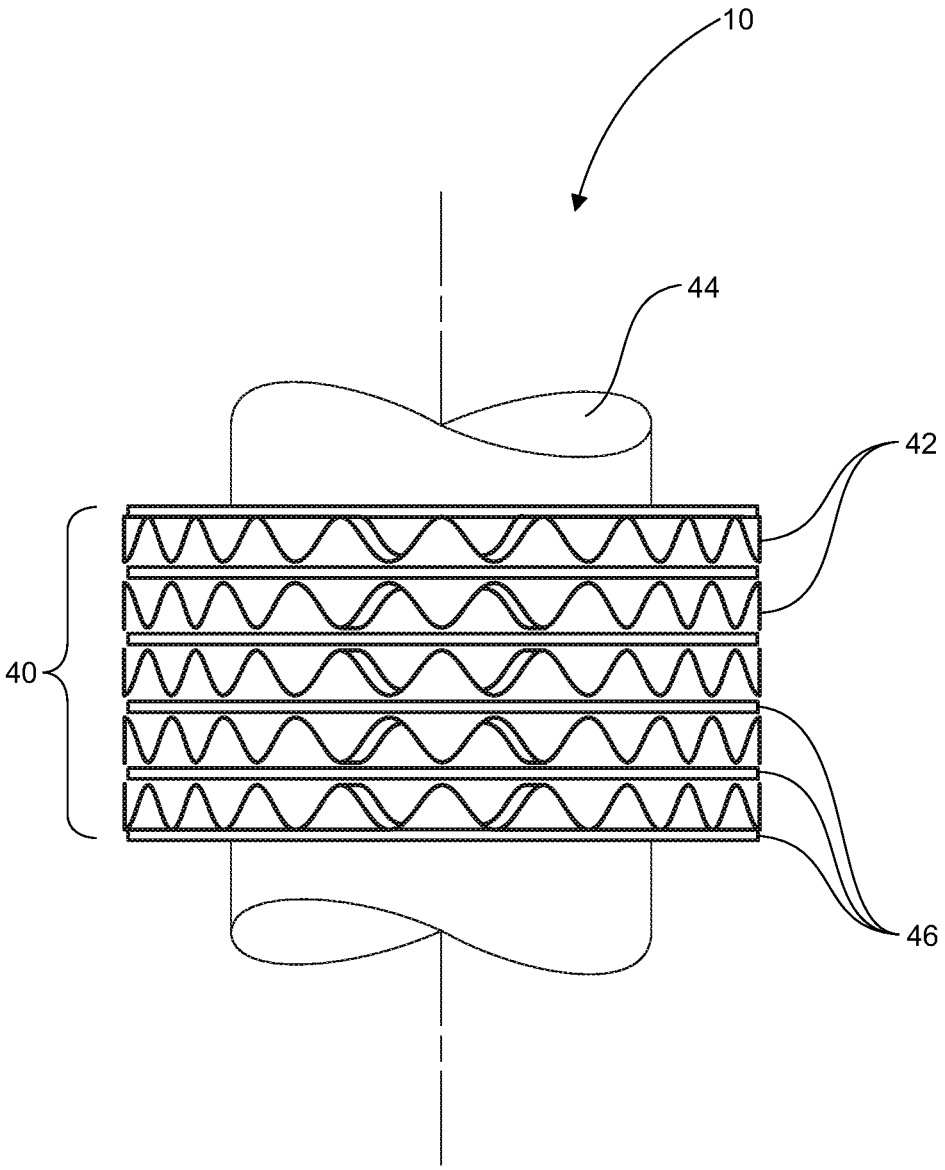
FIG. 2A is a side view of a single use, pleated ring expansion element installed about a mandrel.

As shown in FIG. 2A, the material of the annular pleated rings 42 is formed to undulate axially about the circumference of the ring like a wave disk spring. The pleated ring 42 can be axially compressed against a stop and as the pleat of the ring 42 flattens the added material in the flattened plane results in an increase in the ring's diameter. Like the ubiquitous Belleville spring washers, pleated rings 42 can be stacked in parallel for increase spring resistance or in series for increased deflection. Pleated rings 42 also have a greater capability for both axial and deflection and radial expansions than do the Belleville washers. Two or more pleated rings 42,42 . . . can be aligned axially in parallel, with the peaks and valleys aligned to increase the axial resistance to compression or misaligned angularly and separated by the washers 46 for serial stacking to minimize axial resistance and thus minimize actuation force. The stack 40 of pleated rings 42,42 . . . forms the expandable element 10.

Figure 2C:
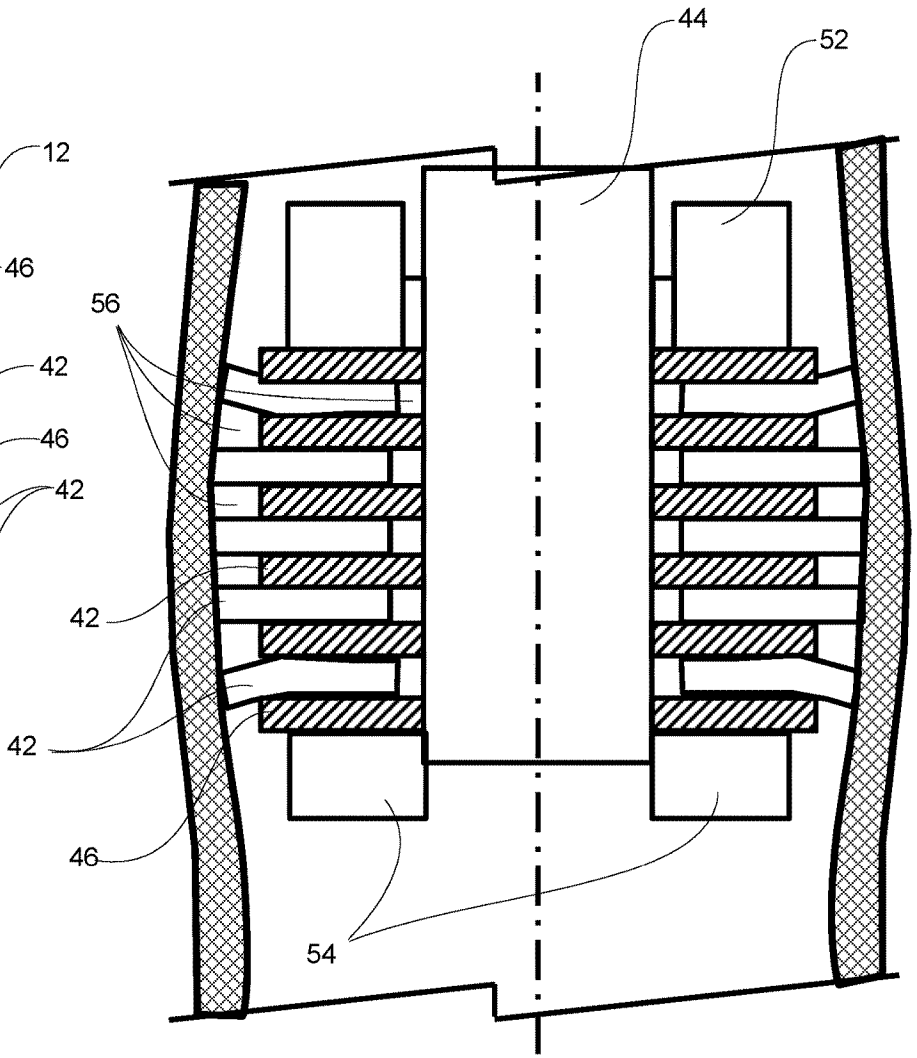
FIG. 2C is a cross-section of the single use, pleated ring expansion element of FIG. 2B after actuation.
Figure 2B:
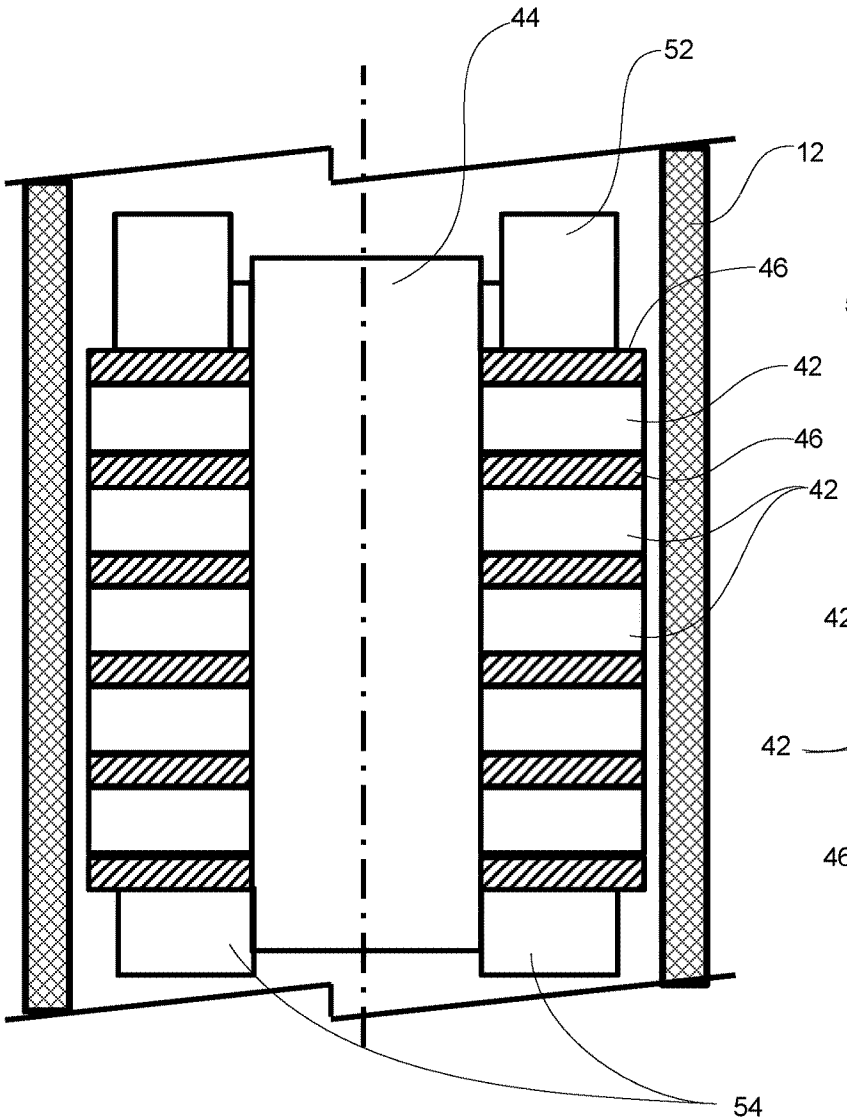
FIG. 2B is a schematic representation of a cross-section of a single use, pleated ring expansion element deployed in casing.

With reference to FIGS. 2B and 2C, a top and bottom of the expandable element 10 is supported axially by first and second stops 52,54 being actuable towards the other stop for compressing the stack 40. In this illustrated embodiment the bottom of the stack 40 is guided axially by the mandrel 44. When actuated, the pleated stack 40 is compressed axially between the first and second stops, so as to cause the pleated rings 42 to flatten between each washer 46.

Figure 3:
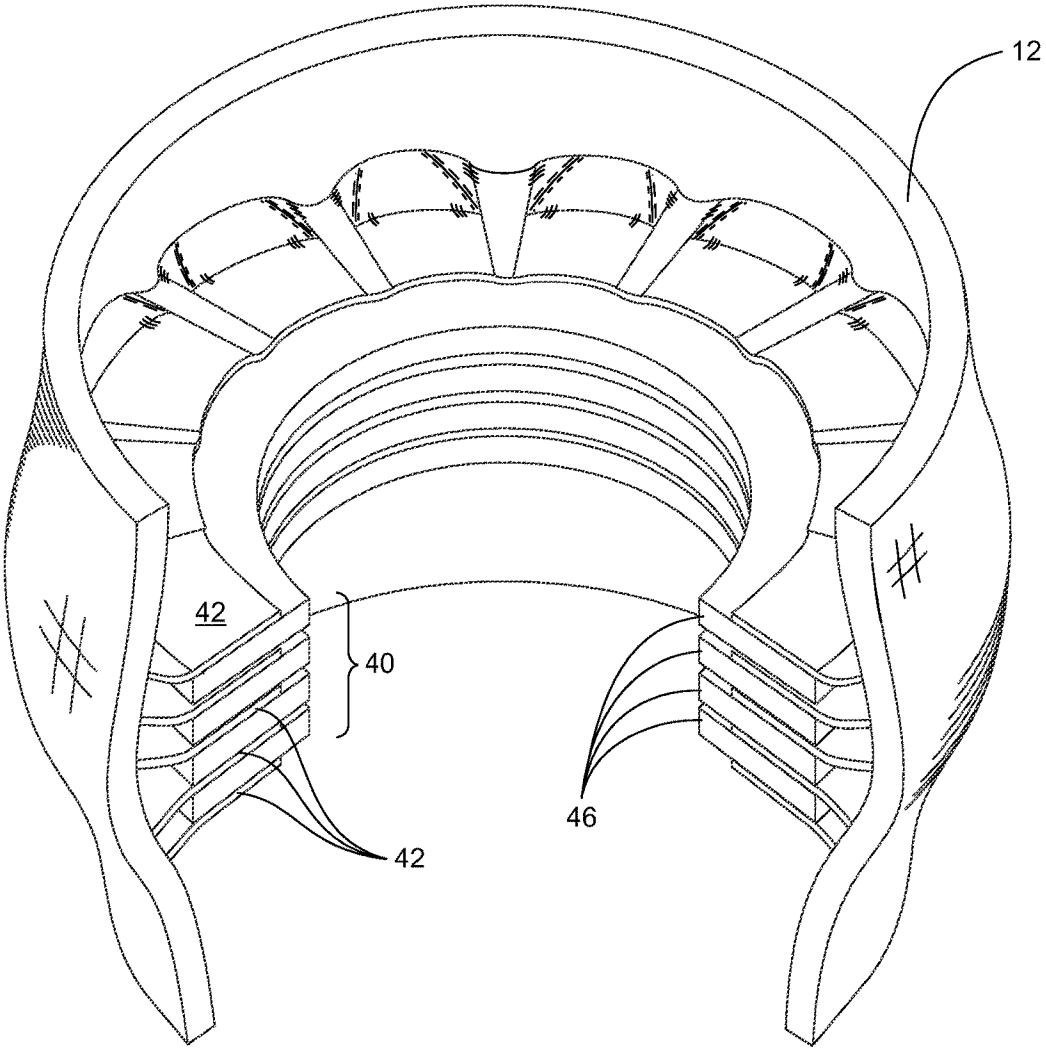
FIG. 3 is a drawing representation of a photograph of a partial section of 5.5" casing expanded by a single use expansion element according to Example 1.
Figure 4B:
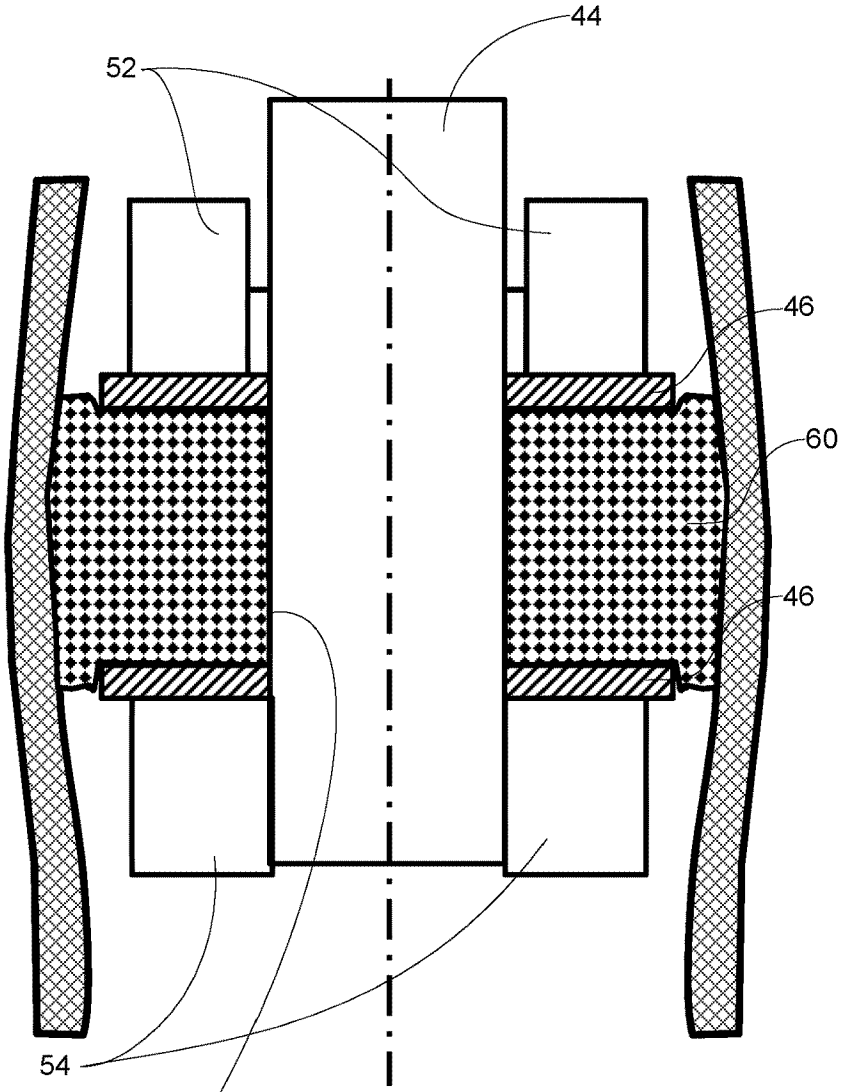
FIG. 4B is a cross-section of the a multi-use, resettable elastomeric expansion element of FIG. 4A after actuation.
Figure 4A:
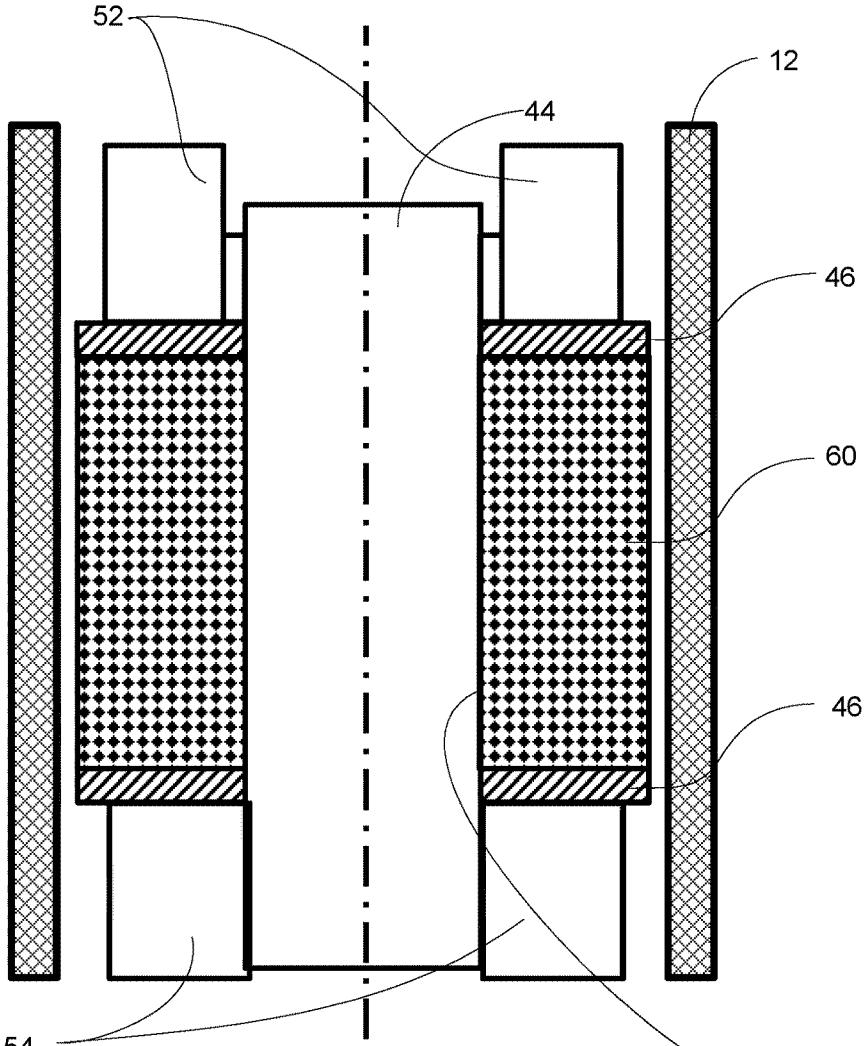
FIG. 4A is a cross-section of a multi-use, resettable elastomeric expansion element deployed in casing.
Figure 5B:
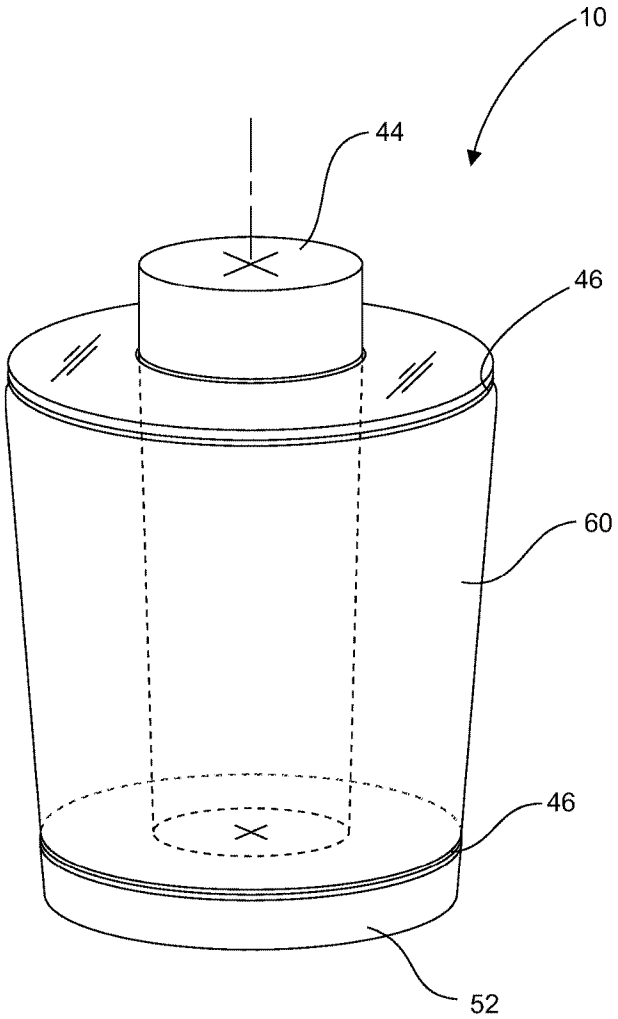
FIGS. 5A and 5B are drawing representations of a photograph of a partial section of 5.5" casing and a multi-use expansion element respectively, the casing having been plastically expanded by the multi-use expansion element of FIG. 10B.
Figure 5A:
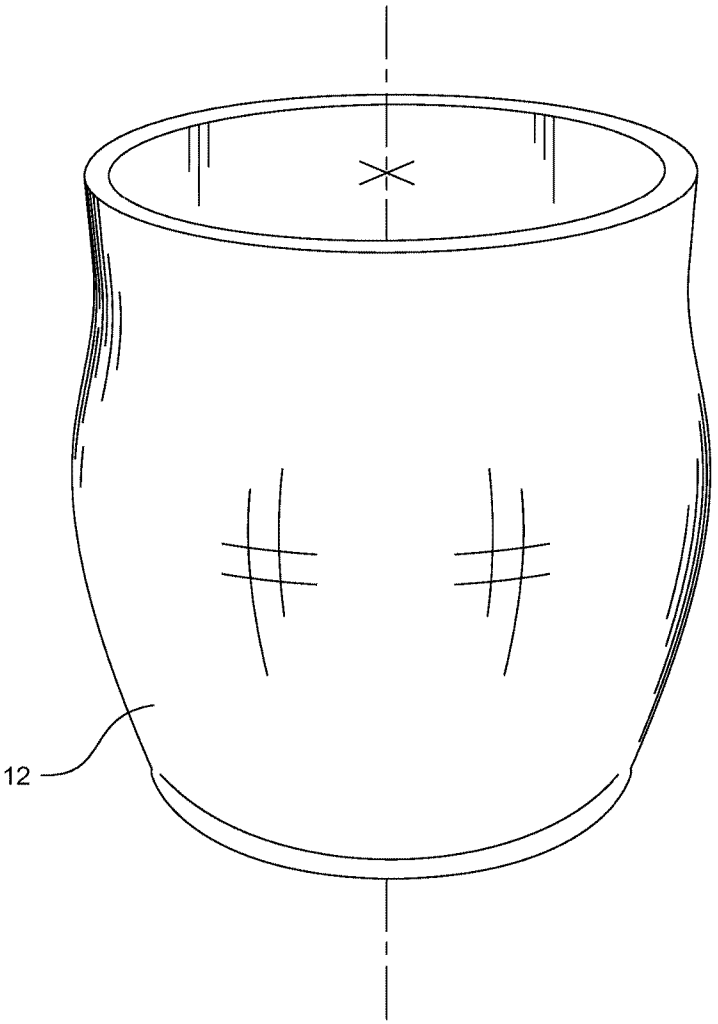

As shown in FIGS. 2C and 3, when flattened axially, each ring 42 expands radially, the expanding rings 42 engaging the inside diameter of the casing 12. As the rings 42 are axially restrained while compressed, dimensional change is directed into a radial engagement with the casing 12, the magnitude of which results in a plastic displacement thereof.

The overall axial height of the stack of pleated rings is limited to concentrate the radial force and hoop stress into the short height of the casing 12. The radial force displaces the casing beyond its elastic limit and imparts plastic deformation over a concentrated, affected casing length for a given axial force. The magnitude of the plastic expansion can be controlled by the magnitude of the axial force.

As shown in FIG. 3, a 5" tall stack of pleated rings 42, having a pleated outer diameter of about 4.887", can be deployed in 5.5", 14 lb/ft casing (5.012" internal diameter ID—nominal 5.5" OD). Depending upon the magnitude of the axial compression, the outside diameter of the casing is readily expanded in the order of 0.875". If evenly distributed circumferentially about the casing 12, this results in a reduction of almost ½ of the radial dimension of the cement sheath 14. Applicant has determined that an expansion of 0.375" on the casing diameter has been effective to shut off surface flow along the cement sheath 14.

In a first example, Example 1, a test expansion element 10 was prepared and comprised a stack of five double-pleated rings 42 separated and isolated by six flat spacer washers 46 for a stack height of about 4.6" to 5.1". The stack height controls the amount of diametrical expansion. The greater the pleat height, the greater the casing expansion. Each ring 42 was a 0.042" thick, fully hardened stainless steel. Between each pleated ring 42 was a strong 0.1875" thick washer 46 of QT1 steel having a 4.887 OD and a 3.017 ID. A 3" diameter test mandrel 44 was provided.

In testing, compression of the stack reduced the stack height by about 1.0" to 1.5" for the 3/16" thru 7/8" expansion respectively. For 5.5", 14 lb./ft J55 casing, having 5.012 ID, a nominal 5.5" OD and a 4.887 drift size. The initial dimensions are 4.887 OD with a 3.017" ID. The flattened ID and OD width varies with the initial pleat height.

At 90 tons (180,000 lbs force) of axial load to flatten the pleats, the OD of a pleated ring 42, having an initial 0.280" pleat height, expanded in diameter from 4.887" OD to 5.280" OD and the ID expanded from 3.017" to 3.410" ID. This resulted in about a 3/16" casing expansion.

For a ring having a 0.380" pleat height, when flattened, expanded in diameter from 4.887" OD to 5.655" OD and the ID expanded from 3.017" to –3.785 ID. This resulted in a 7/8" casing expansion. Applicant believes that the measurements scale proportionately up and down from 4" to 9 3/8" casing.

In other embodiments Applicant may use a semi-solid viscous fluid embedded in the assembled stack 40 to add greater homogeneity thereto. When flattened, the individual pleats impose a plurality of point hoop loads on the casing. Applicant determined that a more distributed load can result with the addition of the viscous fluid or sealant 56 located in the interstices of the stack 40.

A suitable sealant 56 is a hot molten asphaltic sealant that becomes semi-solid when cooled. The stack of pleated rings 42 can be dipped in hot sealant and cooled for transport downhole embedded in the stack between the rings 42 and the washers 46 and within the valleys of the pleated rings 42 themselves. Plastomers are used to improve the high temperature properties of modified asphaltic materials. Low density polyethylene (LDPE) and ethylene vinyl acetate (EVA) are examples of plastomers used in asphalt modification. The sealant can be a molten thermo-settable asphaltic liquid, typically heated to a temperature of about 200° C. Such as sealant is a polymer-modified asphalt available from Husky Energy™ under the designation PG70-28. The described sealant melts at about 60° C. and solidifies at about 35° C.

The semi-solid sealant 56 in the stack of pleated rings, when actuated to the compressed position, seals or fluid exit is at least restricted from between adjacent washers, the mandrel, the adjacent pleated rings and the casing, for further applying fluid pressure to the wall of the casing 12.

Expansion elements 10 assembled from metal tend to be irreversible; once expanded they remain expanded, and as a result tend to become integrated with the casing 12 and thus cannot be reused.

Applicant is aware of abandoned wells that has multiple sources of vent leakage and it is advantageous to be able to expand the casing 12 at multiple locations 13,13 without having to trip out of the well casing 12 to install a new expandable element 10.

Elastomeric

Accordingly, and with reference to FIGS. 4A, 4B, 5A and 5B, in another embodiment, a multiple-use casing expansion element 10 is conveyed downhole and actuated at the target location 13 to expand the casing 12, released and then moved to a successive location. As the magnitude of expansion is related to axial actuation force, An elastomeric cylindrical bushing 60 has a central bore 62 along its axis and is mounted on the mandrel 44 passing therethrough. A suitable elastomeric material is a nitrile rubber, 75 durometer. A bottom of the bushing 60 is supported axially by a downhole stop 54 at a bottom the mandrel 44. A support washer 46, similar to the washers 46 used in the stack 40 of pleated rings.

The actuator sub 26 is fit with an uphole stop 52. When actuated, the bushing 60 is compressed relative to the bottom stop 52, so as to cause the bushing to expand radially related to its Poisson's ratio, engaging the casing 12. As the bushing is axially restrained and compressed, dimensional change is directed into a radial engagement with, and a plastic displacement, of the casing. Again, total axial height of the bushing is limited to concentrate force and maximize hoop stress in the casing 12 for a given axial force.

Generally, the diameter of the mandrel 44 is sized to about 50% to 75% of the outside diameter of the bushing 60. The inside diameter of the bushing 60 is closely size to that of the mandrel 44. For example, for 5.5" 14 lb/ft casing, the bushing height is 5" tall, the OD is 4.887" and the mandrel OD and bushing ID can be 2.125". Rather than changing out the mandrel for different sized elements 10, one can sleeve the mandrel for larger elements. Not shown, the mandrel 44 can also be fit with sleeve for varying the OD to fit the ID of larger bushings. For 9 5/8" 40 lb/ft casing, having a bushing OD of 8.765", a 2.125" mandrel provided with a setting tool for 5.5" casing, can be sleeved to about 4" OD for the larger busing 60.

The elastomeric expansion element 10 has been tested with both 5.5" and 7" casing configurations. In both instances the element 10 has been about 5" tall which creates a bulge or plastic deformation along the wall of the casing 12 of about 3", consistent with the 5" tall pleated ring system.

In both sizes, the lighter weight casing 7", 17 lb/ft J55 and 5.5", 14 lb/ft J55 having wall thicknesses of about 0.25") expands to the point of permanent deformation between 80-90 tons of axial force.

The clearance, or drift, between the outer diameter of the expansion element 10 and the ID of the casing 12 is typically about 1/4", or a 1/8" gap on the radius. In the case of an elastomeric element, capable of multi-use, partial extrusion of the elastomer is inevitable, but discouraged. Beveling of the uphole and downhole stops 52,54, or intermediate washers 46,46, minimizes cutting of the elastomer.

Use of a sleeve on the mandrel, or changing out the mandrel for a larger size keeps the thickness of the annular portion of the element generally constant. As stated, in the 5.5 and 7 inch casing the permanent diameter expansion is typically 5/8" to 7/8".

The casing expansion behaves predictably with increasing axial force and increasing diameter once the steel of the casing begins to yield. Applicant has determined that it is possible to expand casing diameter by up to 1.6" which would completely fill the cement sheath's annular space between most casing and formation completions.

As discussed, the expansion element 10 plastically deforms the casing so that the diametral compression of the cement sheath 14 is maintained after actuation and further, in the case of a multi-use element, after removal of the expansion element 10 for re-positioning to a new location. While the magnitude of the plastic deformation can be larger than that required to shut off the simplest SCVF, it is however a conservative approach to ensure that all of the cement defects are resolved, including, micro-annular leak paths, radial cracks, "worm holes" and poor bonds between cement and geological formation. The minimum expansion provided is that which creates a permanent bulge or deformation in the casing that does not relax when the force is removed.

In testing, Applicant has successfully multi-cycled the elastomeric elements for a dozen or more compression cycles. Applicant also notes that the elastomeric appears to translate the axial force to radial force slightly more efficiently than the pleated ring and viscous fluid system.

In scale up, it is expected that a 220 ton (440,000 lb/ft setting tool will actuate the expansion elements for plastic deformation on thicker and more robust casing, such as the API 5CT L80 and P110 in about 26/ft casing weights (~0.50" wall thickness). Applicant has successfully tested P110 casing with axial loads of 170 tons and the expansion performance is similar to the same way that the tests for lighter casing.

Multi-Use Expansion

With reference to FIGS. 6 through 10, the materials characteristics of casing manufactured with welded seams, such as by electrical resistance welding, vary at the weld area. The welded seams are typically stiffer than the parent casing wall material and thus are variable in their resistance to expansion. Accordingly the resulting periphery of the expanded casing 12 can be asymmetrical, potentially resulting in less robust leak path remediation in the cement sheath at about the seam.

Figure 8:
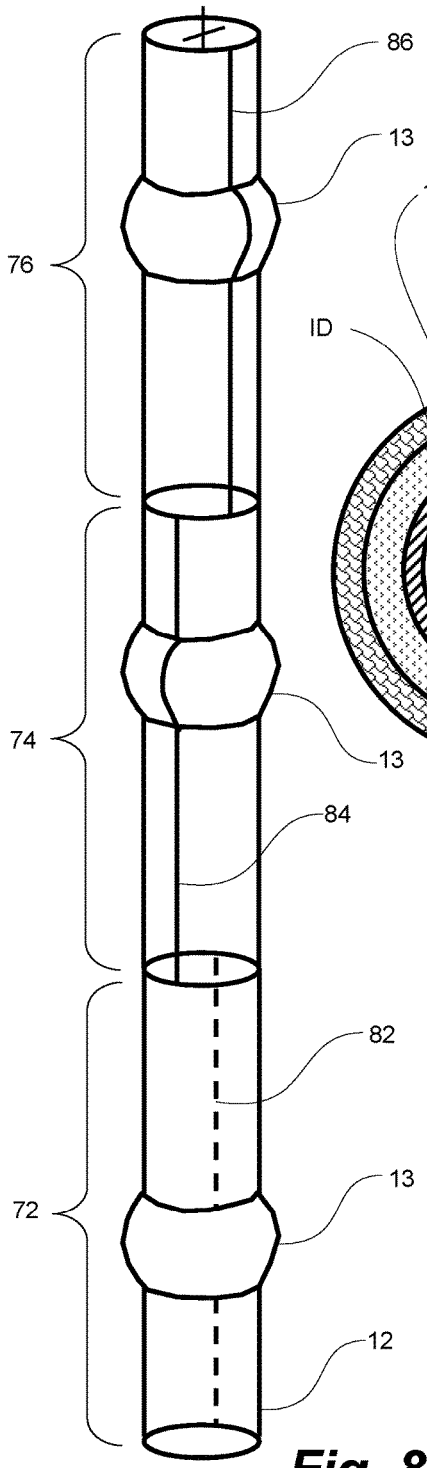
FIG. 8 is a side perspective view of three joints of casing, each joint having a weld seam at a different circumferential location, each joint having had a target location expanded using a multi-use expansion element.
Figure 9:
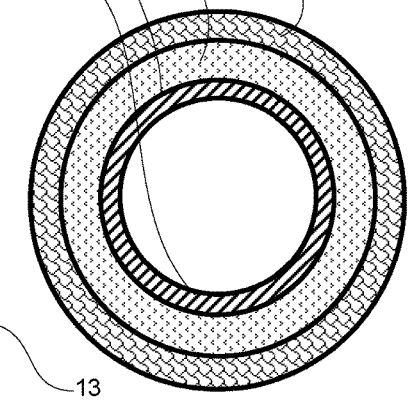
FIG. 9 is a cross-sectional view of the casing of FIG. 8 before expansion.

Accordingly, and with reference to FIG. 8, as a matter of chance, the seam of each connected joint of casing 12 is typically angularly offset from the preceding and subsequent joint. Thus in one embodiment, the setting tool 20 and expansion element 10 are operated at two or more locations spaced along the string of well casing 12. The joints of casing are typically 20-40 ft (6-12 m) lengths and movement between successive joints 12 can be easily accommodated by the wireline or tubing conveyed setting tool 20. It is unlikely that any two separate joints of casing, and it is even less likely that three separate joints of casing have the weld seams aligned. Thus, by performing two or three expansions, the cement sheath is remediated about a full circumferential and annular coverage.

In the event that three, spaced expansions are not sufficient to shut off the SCVF, as evidence by surface testing, one can repeat as necessary without having to replace the elastomeric element.

Turning to FIG. 6 and FIGS. 7A through 7C, the setting tool 20 is illustrated with a plurality of piston modules 26. In an embodiment, the power module and piston modules provide about 17,000 pounds per module; for example, nine modules generate about 80 tons and 13 modules generate 110 tons.

Figures 6, 7A, 7B, 7C:
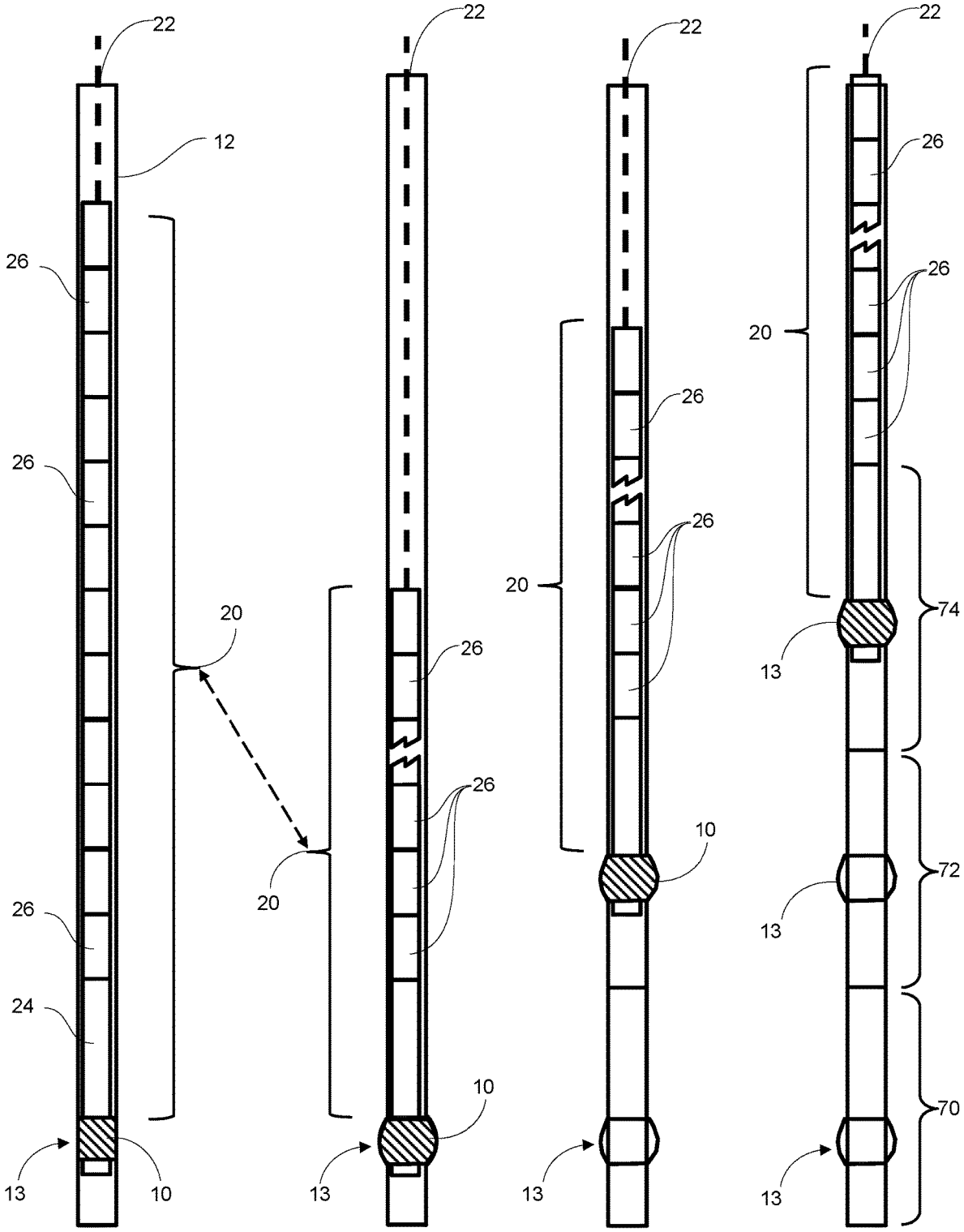
FIG. 6 is a schematic cross-sectional representation of a setting tool having a plurality of piston elements coupled to multi-use expansion element, such as that shown in FIGS. 5A,5B.
FIGS. 7A, 7B and 7C are schematic cross-sections of the setting tool and expansion element of FIG. 5A, actuated in a first joint of casing, moved uphole and actuated in a second successive joint of casing, and moved uphole and actuated in a third successive joint of casing.

As shown in FIG. 6 the setting tool 20 and an expansion element is conveyed downhole on a conveyance string or wireline 22 to a specified location 13 along the casing 12. At FIG. 7A, the setting tool 20 is shown broken in the middle and pistons not illustrated for display purposes. The element 10 is actuated radially outwards to plastically expand the casing 12 at the specified location 13.

At FIG. 7B, the setting tool 20 is actuated to release the expansion element 10. The element contracts radially inward from the casing 12 to its original run-in dimensions. Thereafter the setting tool 20 and expansion element 10 can be moved along the casing, typically uphole to a successive specified location 13 and repeating the actuating and element-releasing steps for expanding the casing 12 again. With reference to FIG. 7C, the expansion element is conveyed along the casing to a successive specified location and repeating the actuating and element-releasing steps.

Setting Tool

As introduced above, the setting tool 20 provides axial forces for actuating the expansion element 10 axially for a corresponding radial expansion.

With a reminder back to FIG. 1, the setting tool 2 comprises the actuating sub supporting the first uphole stop 52, the mandrel 44 and the second downhole stop 54, the piston modules 26, the top adapter sub 28, and the power unit 30.

Turning to FIGS. 11A through 14, the setting tool further comprises a modular tubular body having a contiguous bore 102 and a modular outer sleeve 104. The outer sleeve comprises a series of housings of at least the actuator sub 24, the piston modules 26 and the top adapter sub 26. The downhole end 34 of the outer sleeve forms a first uphole stop 52. The bore 102 of the actuator sub 24 is slidably fit with the 44 mandrel, and the mandrel is fit with the second downhole stop 54. Whichever expansion element 10 is selected is sandwiched between the first uphole and second downhole stops 52,54. Above the actuator sub 24, the outer sleeve 104 comprises the piston modules 26, each module having a piston housing or cylinder 108 fit with a hydraulic piston 106 sealably slidable therein for driving the mandrel 44 and connected downhole stop 54 towards the uphole stop 52, compressing the expansion element 10 therebetween.

Two or more of the pistons 106,106 . . . are coupled axially to each other and to the mandrel 44, such as through threaded connections. As the pistons 106, mandrel 44 and downhole stop 54 are hydraulically driven uphole, the outer sleeve 104 and uphole stop 52 are correspondingly and reactively driven downhole. Reactive, and downhole, movement of the outer sleeve 104 drives the uphole stop 52 towards the downhole stop 54.

Each piston 106 and cylinder 108 is stepped, providing a first uphole upset portion 116 and a second smaller downhole portion 118. The pistons uphole and downhole portions are sealed slidably in the cylinder 108. Hydraulic fluid F under pressure is provided to a chamber 120, situate between the uphole and downhole portions 116,118, which results in a net uphole piston area for an uphole force on the piston 106 and an equivalent downhole force on the outer sleeve 104.

Figure 12:
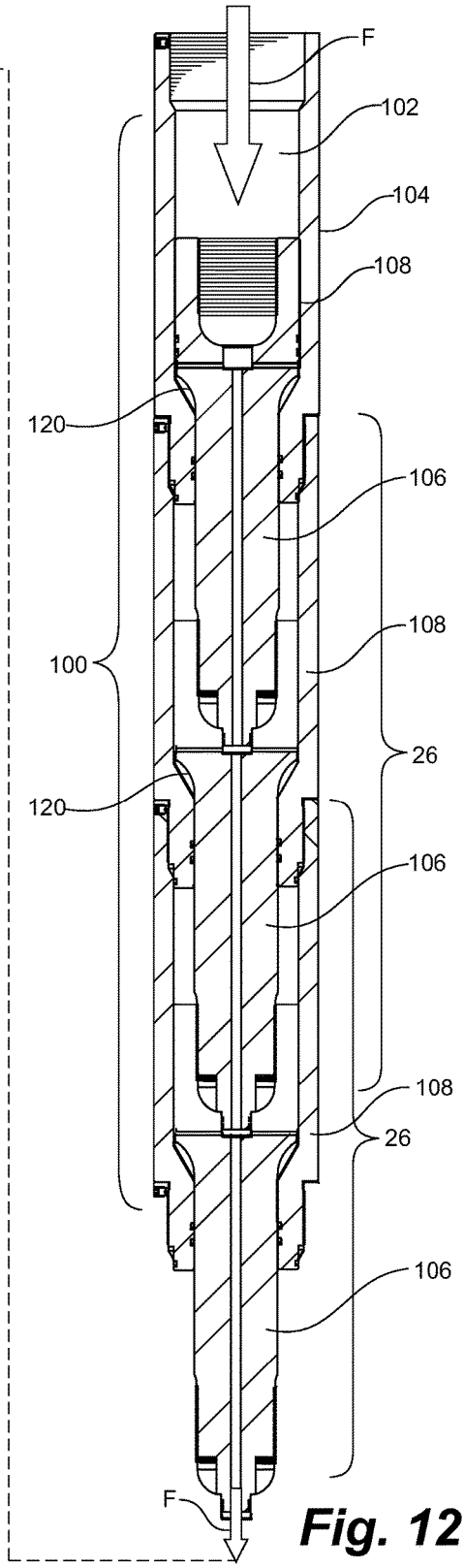
FIG. 12 is a cross-sectional view of several of the piston assemblies of the setting tool of FIG. 1.
Figure 13:
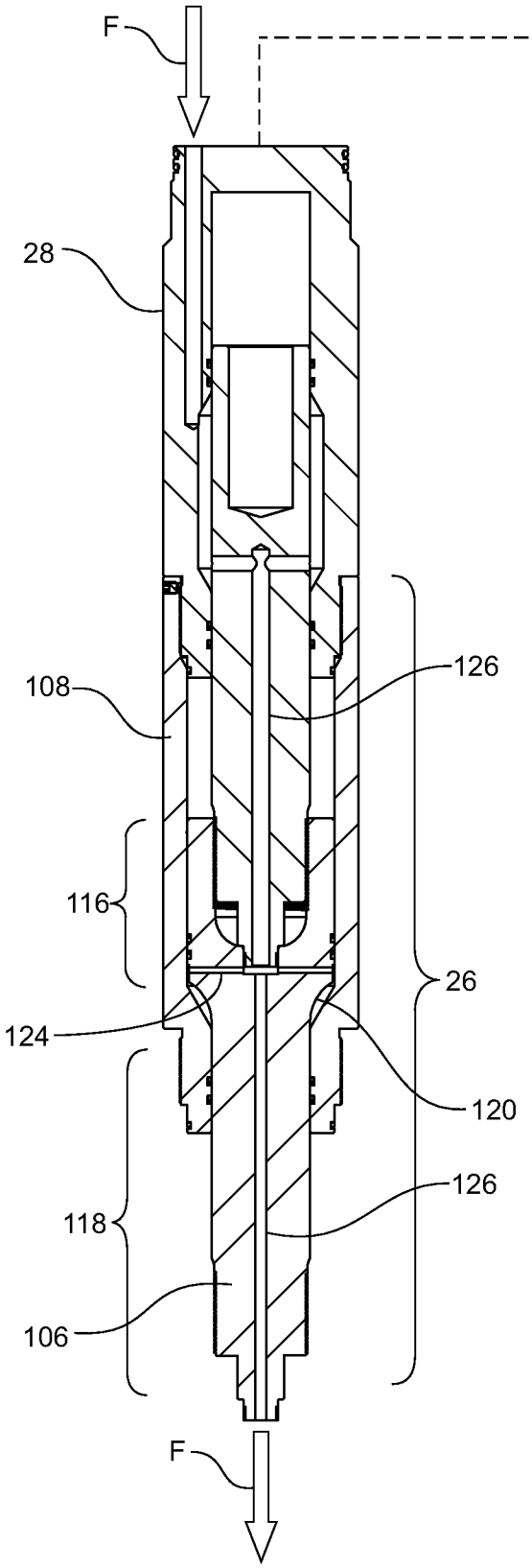
FIG. 13 is a cross-sectional view of a top sub of the setting tool having a piston and hydraulic piston distribution passages.

As shown in FIGS. 12 and 13, a plurality of the piston modules 26 are provided which can be assembled in series for multiplying the actuating force. Each module 26 comprises the stepped cylinder 108 and a stepped-piston 106 therein. As shown in FIG. 13 fluid supply passages 126 extend from the top adapter sub 28 through each piston 106 to the next piston 106. A transverse fluid passage 124 across the piston 106 is in fluid communication between the supply passage 126 and the chamber 120.

Figure 14:
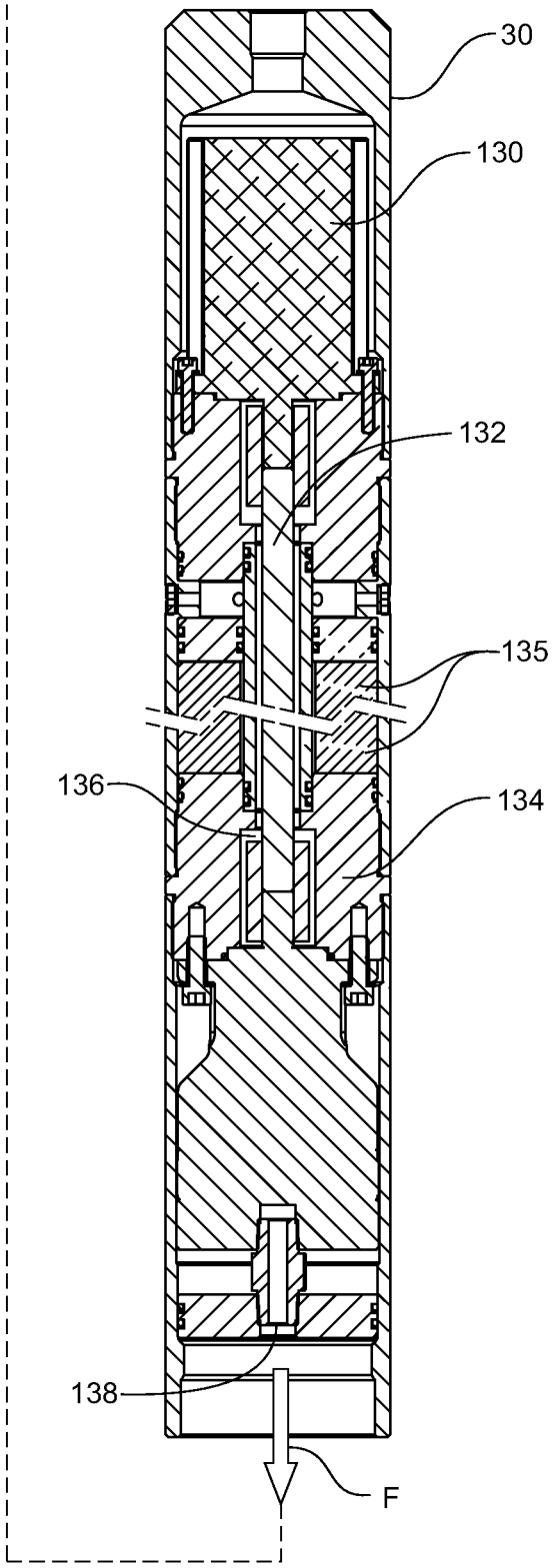
FIG. 14 is a cross-sectional view of the power sub having a motor and pump for an electrical wireline embodiment.

With reference to FIG. 14, the power sub 30 provides the actuating hydraulics for the piston modules 26. A motor 130, such as an electrical motor, is carried within the power sub and connected through the wireline 22 to a source of electric power at the well surface, the motor 130 having an output shaft 132. A hydraulic pump 134 is also carried within the power sub 30, having a fluid intake 136 and fluid output 138. The pump 134 is coupled to the output shaft 132 of the motor 130 and driven thereby. A hydraulic reservoir 135 can be fit into power sub, or a separate tank sub (not shown), having sufficient volume corresponding to the number and stroke of the piston modules 26. The fluid output 138 is in fluid communication with the ganged and stepped pistons 106, 106 . . . and supplies pressurized hydraulic fluid F to the chambers 120 between the pistons 106 and the cylinders 108 of the sleeve 104.

The actuator sub 24 includes the mandrel 44 and a piston connector 122 between the pistons 106 and the mandrel 44. If the expansion element 10 is a single use element, then the mandrel 44 is releasably coupled to the balance of the setting tool 20. The mandrel 44 can be fixed to the piston connector 122 or releasable therefrom. For a multi-use element, the mandrel 44 is not necessarily releasably coupled, the mandrel being required during each of multiple expansions along the casing 12. Regardless, as if conventional for downhole, multi-component tools, for emergency release the mandrel 44 can be coupled with s shear screw or other overload safety.

For the instance of a single use expansion element, such as the stack 40 of pleated rings 42, the mandrel 44 is releasably coupled to the adapter sub 24. The adapter sub 24 and mandrel 44 further include a J-mechanism 140 having a J-slot housing 142 and a J-slot profile 144 formed in the mandrel 44. The J-slot housing and J-slot profile are coupled using pins 146. The J-slot housing 142 is connected to the piston connector 122 for axial movement within the adapter sub's outer shell 104 as delimited by the J-slot profile 144. The J-slot housing, pin 146 and J-slot profile connect the piston connector 122 to the mandrel 44. For managing large axial loads, the J-slot profile 144 can have multiple redundant pin 146 and slot 144 pairs for distributing the forces.

Figure 11A:
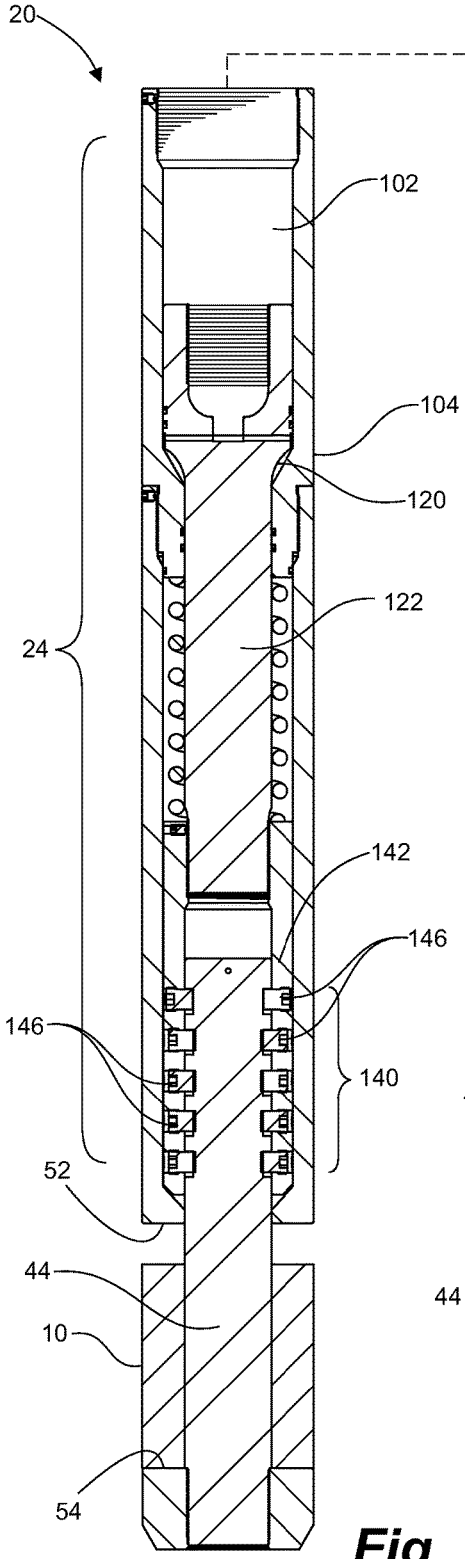
FIG. 11A is a cross-sectional view of the mandrel and shifting housing of the wireline setting tool of FIG. 1.
Figure 11B:
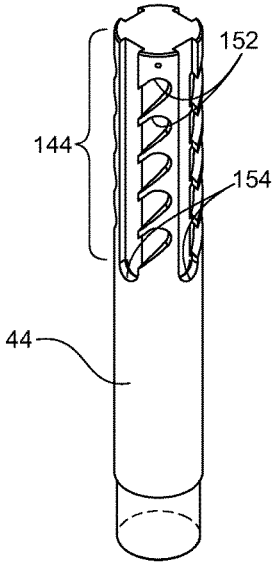
FIG. 11B is a perspective view of the mandrel and a J-slot profile for compression and release of the expansion element.

With reference to FIGS. 11A and 11B, each J-slot profile 144 has an uphole J-stop 152 for enabling axial force on the mandrel 44 and therefore the downhole stop 154 to compress the expansion element 10 against the uphole stop 52. Upon completion of the expansion step, the hydraulic force on the pistons 106, 106 is released and the J-slot housing 142, and pins 146 move along the J-slot profile 146 to an axial release slot 154. The J-slot housing 142 can be biased to a downhole position using a return spring 160 to release compression on the element 10. A suitable return spring rate can be about 185 lbs/in. When the spring 160 is compressed 2.50" results in a 462.5 lb force. The pins 146 align with the axial release slot 154 and the adapter sub 24 and setting tool 20 generally can be pulled free of and off of the mandrel 44. For stepped pistons having a large end OD of 3.187" and a small end of OD 2.127, an assembly of 10 pistons 106 will provided over 110 tons of force.

In the case of a multi-use expansion element, such as the elastomeric element 10, the mandrel 44 remains connected to the piston connector 122 for repeated compression and release of the element ad different specified location 13. If either single use or multi-use expansion elements are to be used with the same setting tool, the J-mechanism 140 for release of the mandrel maybe enabled or disabled. A disabled J-mechanism 140 may include a locking pin or J-slot blanks fit to the J-profile to prevent J-slot operations.

Operation

As described in more detail above, and with reference again to FIGS. 6 to 7C for multi-use operations, the setting tool 20 and an expansion element 10 are conveyed downhole to a specified location 13 along the casing 12. The element 10 is actuated radially outwards to plastically expand the casing 12 at the specified location 13. The setting tool 20 is actuated to release the expansion element 10. The hydraulic fluid can be directed back the reservoir 135. The element 10 contracts radially inward from the casing 12 to its original run-in dimensions. Thereafter the setting tool 20 and expansion element 10 are moved along the casing 12, typically uphole, to a successive specified location 13 for repeating the actuating and element-releasing steps for expanding the casing 12 again. The expansion element moved from location to location along the casing for repeating the actuating and element-releasing steps.

Figure 10C:
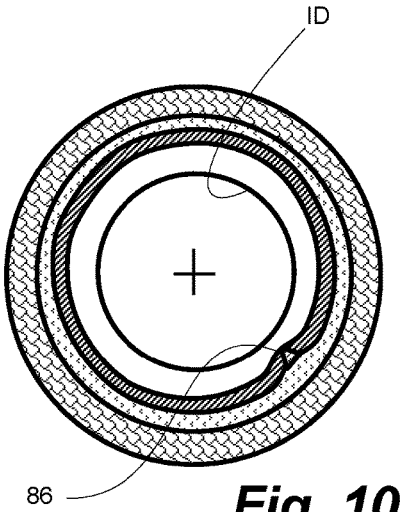
FIGS. 10A, 10B and 10C are cross-sectional views taken at the specific location of expansion for each of the three joints of casing of FIG. 8, each illustrating a stiff weld effect at a different circumferential location about the cement sheath.
Figure 10B:
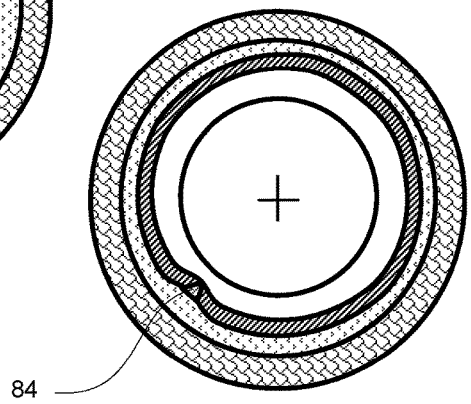
Figure 10A:
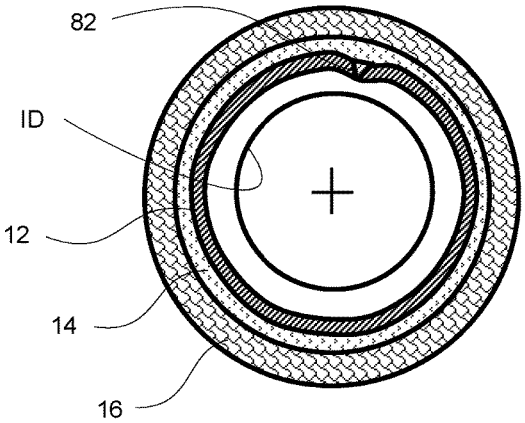

With reference to FIG. 8, three joints of casing 72,74,76 are illustrated, each having a seam 82,84,86 respectively. Note a fanciful, but typical rotational misalignment of the seams 82,84,86. FIGS. 10A, 10B and 10C correspond with cross sections of the expanded locations 13 for each joint of casing 72,74,76 respectively. In FIG. 10A, a less than uniform expansion of the casing 12 illustrated at the weld 82 with less compression and possibly less remediation of the cement sheath at that angular position. However, through a subsequent expansion for the successive joint 74, the similar expansion defect at the weld 84 is rotated relative to the weld 82 below, any axial path of gas up the cement sheath past weld 82 being captured by the successful remediation for the successive joint 74 above. Similarly, with reference to FIG. 10C, the third joint has a potential stiff weld expansion defect at weld 86, but it is unlikely to be axially in line with either of the lower welds 82,84, again sealing the cement sheath against imperfect remediation therebelow. It is expected that with the large plastic expansions now possible, even the areas of the casing have a weld seam will be sufficiently expanded to heal the cement sheath thereat.

Turning to the single use element of FIGS. 2A, 2B and 2C, and with reference also to FIGS. 15A through 15E, the method of operation includes running the setting tool 20 downhole, setting the element 10, releasing the element, abandoning the element and tripping out the setting tool.

Figures 15A, 15B, 15C, 15D, 15E:
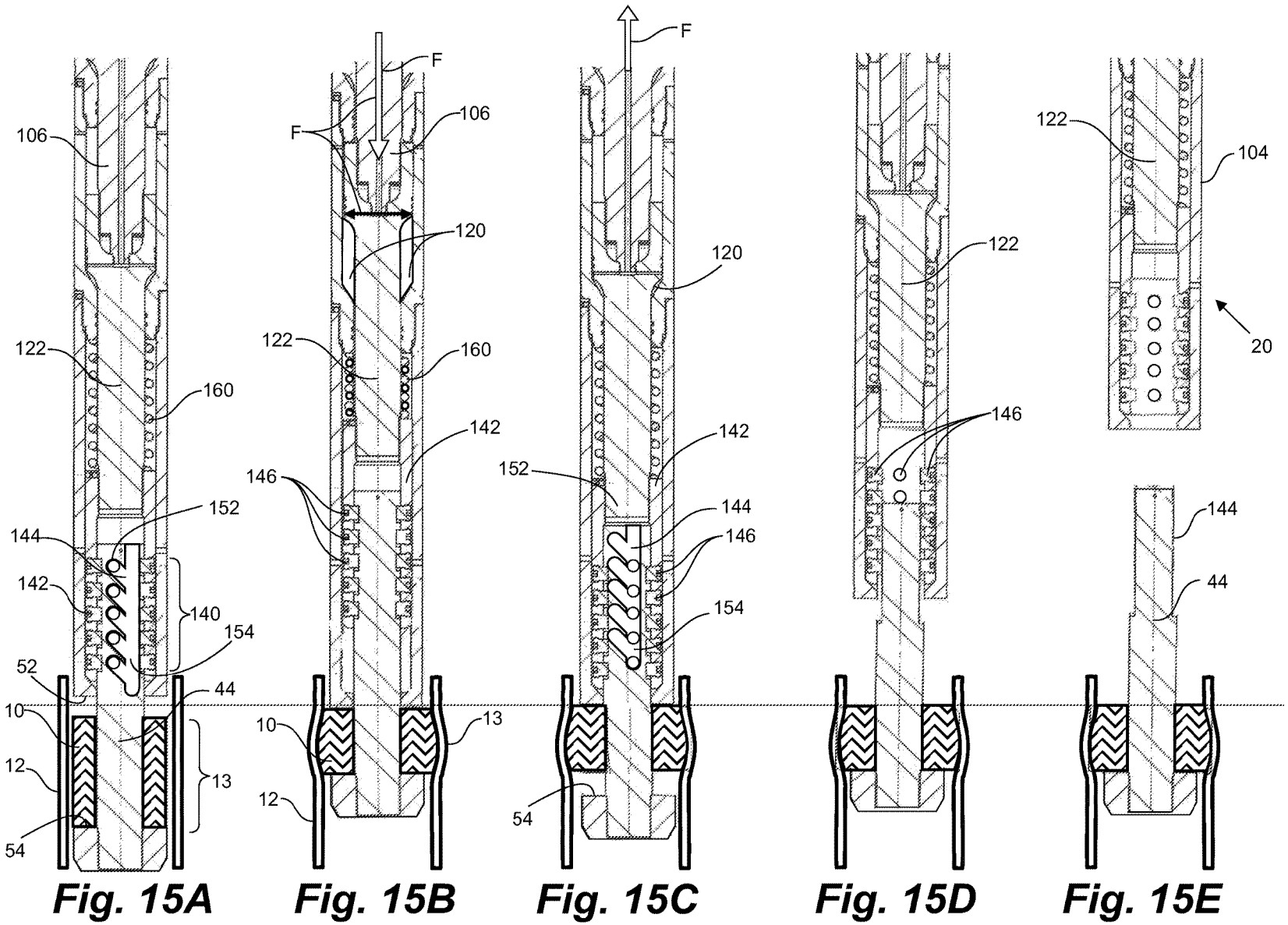
FIGS. 15A through 15E are sequential steps of the operation of the setting tool and a single use expansion element, namely running in hole to a target location, actuating the expansion element, releasing the settling tool from the mandrel, withdrawal of the setting tool from the mandrel and pulling the setting tool out of hole, respectively.

In FIG. 15A, the setting tool 20 and element 10 are run into the well casing 12 to a specific location 13. The power sub 30 provides fluid F to the pistons 106. The pistons 106 shift uphole, driving the downhole stop 54 uphole, compressing the element 10 against the uphole stop 52. In FIG. 15B, one can see a piston chamber 120 filled with fluid F and piston connector 122 uphole, and correspondingly the pins 146 of the J-slot housing 144 having pulled the mandrel and downhole stop 54 uphole to compress the element 10. As a result, sufficient load is applied to the expansion element 10 to expand the element radially into the casing 12 and plastically deform the casing 12 and impinge on the cement sheath at the location 13.

Turning to FIG. 15C, the hydraulic fluid pressure is released and return spring 160 drives J-slot housing 142 downhole. The housing pins 146 follow the J-slot profile 144 from the uphole stops 152 to the axial release slot 154. The single use expansion element 10 remains engaged with the casing 12 and the mandrel 44 may or may not move axially through the element 10.

With reference to FIG. 15D, as the pins 146 are axially aligned with the axial release slot 154 of the J-slot profile 144, setting tool 20 can be pulled uphole and the pins 146 move unrestricted along the slot 154 to leave the mandrel 44 behind in the casing 12. In FIG. 15E, the setting tool 20 continues uphole to surface.

In other embodiments the setting tool 20 and expansion element 10 can be applied in well systems that previously used swaging for plastically expanding pipe, tubing and casing. The current tool now enables axial actuation, at a specific location, for plastic expansion of tubulars of various configurations including liner hangers and casing patches. With axial setting forces now available in the hundreds of thousands of pounds, and an effective axial actuation to radial displacement, casing with wall thicknesses of up to ½" or more are now available to completions, service, and abandonment companies.

We claim:

1. A downhole tool, conveyable downhole along an axis of a well casing, the downhole tool comprising:

a setting tool comprising an axial actuator;

an expansion element having a first diameter in an uncompressed position for conveyance along the well casing, the expansion element being compressible axially by the axial actuator for expanding radially to a second diameter in a compressed position for plastic deformation of the well casing, the expansion element comprising a stack of pleated rings;

a tubular body defining a bore axially therethrough and comprising a plurality of cylinders, the bore extending through the cylinders, wherein the axial actuator comprises a plurality of axially stacked piston modules, each comprising: a respective one of the cylinders and a respective piston axially drivable within the bore relative to the respective cylinder; and a mandrel, wherein the expansion element is mounted on the mandrel, and the mandrel is axially drivable by the pistons for axially compressing the expansion element.

2. The tool of claim 1, wherein: the tubular body includes an outer sleeve comprising the cylinders of the stacked piston modules; the outer sleeve forms a first stop and the mandrel supports a second stop; the expansion element is mounted over the mandrel intermediate the first and the second stops; and the axial actuator is operable to drive the mandrel and the second stop relative to the first stop to compress the expansion element therebetween.

3. The tool of claim 2, wherein the outer sleeve has an uphole end adapted for conveyance and a downhole end forming the first stop, the mandrel extending telescopically from the downhole end.

4. The tool of claim 1, wherein in the uncompressed position, the stack of pleated rings has a first diameter less than that of the well casing and when in the compressed position, the stack of pleated rings has a second diameter adapted to engage the well casing.

5. The tool of claim 1, wherein the tubular body is conveyed by electrical wireline, the axial actuator further comprising:

an electric motor within the tubular body and connected through the wireline with a source of electric power at surface; and a hydraulic pump within said tubular body and having a source of hydraulic fluid and a fluid output, the pump being drivably coupled to the motor, the fluid output being fluidly connected to the pistons.

6. The tool of claim 4, wherein the stack of pleated rings comprises a plurality of wave spring rings separated and spaced apart by annular washers and slidably mounted about the mandrel between the first and second stops, each pleated ring having axially undulating peaks and valleys and, when compressed between the first and second stops, the peaks of each pleated ring flatten against the washers and the second diameter increases to engage and plastically expand the well casing.

7. The tool of claim 6, wherein the stack of pleated rings further comprises a viscous fluid in interstices between peaks of the pleated rings, and when the stack of pleated rings is actuated to the compressed position, the viscous fluid seals between adjacent washers, the mandrel, the adjacent pleated rings and the well casing when for further applying fluid pressure to the well casing.

8. A method for remediation of a well including a wellbore, a well casing positioned in the wellbore and having an annular space between the casing and the wellbore and having a cemented sheath in the annular space about the well casing, the method comprising:

conveying an expansion element downhole on a conveyance string to a first location along the casing, the expansion element being mounted over and extending circumferentially about a mandrel of the conveyance string, and wherein the expansion element is axially compressible for radial expansion;

actuating the expansion element radially outwards, by axial compression of the expansion element, to plastically expand the well casing circumferentially at the first location, thereby compressing the cement sheath within the annular space at the first location to remediate the cement sheath at the first location.

9. The method of claim 8, further comprising the step of releasing the expansion element, thus radially expanded, from the conveyance string for abandonment in the well casing.

10. The method of claim 8, further comprising the step of contracting the expansion element radially inwards from the well casing, thus expanded, to allow axial movement of the expansion element within the well casing.

11. The method of claim 10, further comprising the steps of:

conveying the expansion element to a second location along the well casing; and actuating the expansion element radially outwards to plastically expand the well casing at the second location.

12. The method of claim 8, wherein the expanding of the expansion element radially is irreversible.

13. The method of claim 8, wherein the expanding of the expansion element radially is reversible.

14. The method of claim 8, further comprising the steps of:

radially contracting the expansion element inwards from the well casing at the second location;

conveying the expansion element to at least one further location along the well casing; and for each at least one further location, actuating the expansion element radially outwards to plastically expand the well casing at the respective further location and then radially contracting the expansion element.

15. The method of claim 8, wherein, prior to the step of actuating the expansion element radially outwards to plastically expand the well casing, the well exhibits surface casing vent flow.

16. A method for remediation of a well including a wellbore, a well casing positioned in the wellbore, and an annular space between the casing and the wellbore, and having a cemented sheath in the annular space about the well casing, the method comprising:

conveying an expansion element downhole on a conveyance string to a location along the casing, the expansion element comprising an elastomeric cylindrical ring mounted over and extending circumferentially about a mandrel of the conveyance string, and wherein the elastomeric cylindrical ring is axially compressible for radial expansion;

axially compressing the elastomeric cylindrical ring, the axial compression causing radial expansion of the elastomeric cylindrical ring to plastically expand the well casing circumferentially at the first location, thereby compressing the cement sheath within the annular space at the first location to remediate the cement sheath at the first location.

17. The method of claim 16, wherein the outer diameter of the casing is expanded by at least ⅝ of an inch at the location for compressing the cement sheath at the location.

18. The method of claim 16, further comprising axially decompressing the elastomeric cylindrical ring, thereby radially contracting the elastomeric cylindrical ring inwards from the well casing, thus expanded, to allow axial movement of the elastomeric cylindrical ring within the well casing.

19. The method of claim 18, further comprising:

conveying the expansion element to a second location along the well casing; and actuating the expansion element radially outwards to plastically expand the well casing at the second location.

* * * * *